US006676178B2

(12) United States Patent
Budhrani

(10) Patent No.: US 6,676,178 B2
(45) Date of Patent: Jan. 13, 2004

(54) DOOR LOCK ASSEMBLY HAVING ESCUTCHEON WITH REMOVABLE POSTS

(75) Inventor: Haresh Budhrani, Taichung (TW)

(73) Assignee: Imperial USA, Ltd., Charlotte, NC (US)

( * ) Notice: Subject to any disclaimer, the term of this patent is extended or adjusted under 35 U.S.C. 154(b) by 168 days.

(21) Appl. No.: 09/833,860

(22) Filed: Apr. 13, 2001

(65) Prior Publication Data

US 2002/0149211 A1 Oct. 17, 2002

(51) Int. Cl.[7] ..... E05B 15/02

(52) U.S. Cl. ..... 292/357; 292/348; 292/169; 292/169.13; 292/DIG. 53

(58) Field of Search ..... 292/DIG. 53, DIG. 64, 292/165, 169, 169.13, 169.17

(56) References Cited

U.S. PATENT DOCUMENTS

| | | | |
|---|---|---|---|
| 24,214 | A | 5/1859 | Howland |
| 1,215,686 | A | 2/1917 | McKay |
| 1,546,626 | A | 7/1925 | Crouch |
| 1,641,537 | A | 9/1927 | Halpern |
| 1,661,454 | A | 1/1928 | Wilson |
| 2,175,791 | A | 10/1939 | Brauning |
| 2,230,096 | A | 1/1941 | Voight |
| 2,425,239 | A | 8/1947 | George |
| 2,444,819 | A | 7/1948 | Freysinger |
| 2,676,827 | A | 4/1954 | Schlage |
| 2,677,263 | A | 5/1954 | Smith |
| 2,800,347 | A | 7/1957 | Wardwell, Jr. |
| 2,961,866 | A | 11/1960 | North et al. |
| 2,978,267 | A | 4/1961 | North et al. |
| 3,018,651 | A | 1/1962 | Morrison, Jr. |
| 3,186,747 | A | 6/1965 | Hamm et al. |
| 3,220,231 | A | 11/1965 | Wilson |
| 3,228,218 | A | 1/1966 | Wilson |
| 3,232,653 | A | 2/1966 | Wilson |
| 3,240,040 | A | 3/1966 | Wilson |
| 3,253,848 | A | 5/1966 | Wilson |
| 3,323,824 | A | 6/1967 | James |
| 3,354,676 | A | 11/1967 | Wilson |
| 3,363,926 | A | 1/1968 | Wilson |
| 3,425,247 | A | 2/1969 | Etter |
| 3,510,161 | A | 5/1970 | Wilson |
| 3,699,788 | A | 10/1972 | Gerlach et al. |
| 3,790,196 | A | 2/1974 | Sanders et al. |
| 3,899,907 | A | 8/1975 | Prahl |
| 3,910,613 | A | 10/1975 | Nolin |
| 3,971,239 | A | 7/1976 | Lavis |
| 3,990,277 | A | 11/1976 | Mullich |
| 4,011,741 | A | 3/1977 | Nolin |
| 4,012,929 | A | 3/1977 | Solovieff |
| 4,109,494 | A | 8/1978 | Allemann |
| 4,169,618 | A | 10/1979 | Potter et al. |
| 4,236,396 | A | 12/1980 | Surko, Jr. et al. |
| 4,272,974 | A | 6/1981 | Hennessy |
| 4,338,806 | A | 7/1982 | Cox |

(List continued on next page.)

*Primary Examiner*—J. J. Swann
*Assistant Examiner*—Thomas Ho
(74) *Attorney, Agent, or Firm*—Sughrue Mion, PLLC

(57) ABSTRACT

A door lock assembly having a first escutcheon assembly for mounting a latch mechanism. The escutcheon includes a plate having a through-hole, first and second post mounts formed on an inward facing side of the plate outside the through-hole, and first and second removable posts that are removably coupled to the first and second post mounts, respectively, such that they are removable without permanent alteration to the escutcheon. The latch mechanism includes a shaft coupled with the bushing, a torsion spring having two distal ends for centering an angular position of the, wherein the two distal ends rest against a stop formed on the inward facing side of the escutcheon, and wherein at least one distal end is engaged with the off-centered protrusion of the bushing. The bushing may also include an ear protruding radially for engagement with a penannular portion formed in the through-hole of the escutcheon.

11 Claims, 6 Drawing Sheets

U.S. PATENT DOCUMENTS 4,422,677 A 12/1983 Gater
4,432,576 A 2/1984 Wartian
4,446,707 A 5/1984 Mullich et al.
4,453,753 A 6/1984 Fayerman et al.
4,470,278 A 9/1984 Hale et al.
4,573,334 A 3/1986 Crepinsek
4,575,137 A 3/1986 Jans
4,615,549 A 10/1986 Couture
4,671,089 A 6/1987 Fleming et al.
4,711,477 A 12/1987 Fann et al.
4,746,154 A 5/1988 Fang
4,750,766 A 6/1988 Shen
4,784,417 A 11/1988 Fleming et al.
4,804,216 A 2/1989 Marotto
4,850,626 A 7/1989 Gallego
4,869,083 A 9/1989 DeMarseilles et al.
4,876,866 A 10/1989 Fleming et al.
4,890,871 A 1/1990 Lin

DOOR LOCK ASSEMBLY HAVING ESCUTCHEON WITH REMOVABLE POSTS

TECHNICAL FIELD

This invention relates generally to a door lock assembly having an escutcheon for mounting a door lock mechanism, and more particularly to a door lock assembly having an escutcheon with removable posts for mounting a locking mechanism, including door latch and deadbolt mechanisms, on doors having different cross bore diameters.

BACKGROUND

Known door lock assemblies, including an escutcheon and a door latch, a door deadbolt, or a combination door latch and deadbolt mechanism come in different sizes, each in accordance with an industry standard that is compatible with a corresponding industry standard door cross bore diameter.

FIG. 1 illustrates an exploded view of a door and door lock assembly 101. Door 102 has two cross bores, a top cross bore 103 for a deadbolt mechanism, and bottom cross bore 104 for a latch mechanism. The diameters $D_{103}$ of the cross bore 103 and $D_{104}$ of the cross bore 104 can have one of a plurality of industry standard sizes. The door lock assembly 110 includes an inside escutcheon 111, an outside escutcheon 112, an inside latch handle 113 and an outside latch handle 114 for operating a latch mechanism 115, and a thumb turn 116 for operating a deadbolt mechanism 117.

When mounting the door lock assembly 110 to the door 102, it is important to properly align the inner and outer escutcheons with respect to the center axes of the cross bores and with respect to the vertical and backset positions of the latch and deadbolt mechanisms. Accordingly, conventional door lock assemblies have been designed to fit one standard cross bore size, requiring multiple designs to cover the various industry standard cross bore sizes. This has led to an increase in the manufacturing and stocking costs for door lock assemblies.

U.S. Pat. No. 4,671,089 discloses a door latch and deadbolt assembly aimed at facilitating the assembly's mounting to doors having different cross bore diameters. Specifically, referring to FIG. 1, this patent discloses a combination door latch and deadbolt assembly 110 including an escutcheon 111, 112 with breakaway tabs 118 for mounting the escutcheon to doors having different standard cross bore diameters. When left on the escutcheon upon installation, the breakaway tabs allow the escutcheon to be snugly mounted to a door having a cross bore with a first diameter. However, when the breakaway tabs are broken off from the escutcheon, the escutcheon can be snugly mounted to a door having a cross bore with a second diameter that is larger than the first diameter.

The breakaway tabs disclosed in U.S. Pat. No. 4,671,089 are formed as protrusions that are integrally molded to the inner face of the escutcheon, so that they can be removed only by breaking (i.e., permanently severing) the tabs from the escutcheon. The patent teaches that this frangibility of the tabs is an important feature, since it allows the escutcheon to be quickly adapted to a larger cross bore size by breaking off one or more tabs. However, since removal of the tabs results in the permanent alteration of the structure of the escutcheon, once the tabs are broken, it is impossible to re-adapt this escutcheon to fit a cross bore having a smaller diameter. Therefore, any mistake in sizing the escutcheon to the cross bore will result in the need to purchase a new escutcheon or door lock assembly.

A further problem encountered in known door latch assemblies involves assembling the latch mechanism to the escutcheon. For example, U.S. Pat. No. 4,671,089 discloses a latch mechanism design in which the latch socket (also referred to as a bushing) is inserted into a through-hole in the escutcheon for the latch mechanism from the outward facing side of the escutcheon, and held in place prior to attachment of the latch handle by a retainer ring (also referred to as a circular clip) attached to the socket from the inward-facing side of the escutcheon. Accordingly, the assembly process is cumbersome, requiring the additional handling and fixing of the retainer ring.

This invention is directed to overcoming one or more of the problems that is set forth above.

SUMMARY OF THE INVENTION

According to the present invention a door lock assembly is provided that includes an escutcheon and a door latch and deadbolt mechanism having diametrically opposed post mounts, preferably with threaded holes, each post mount coupled to a removable post such as a headless screw so as to be removable without permanent alteration to the escutcheon. The combination post mounts and removable posts provides a mechanism that allows onsite modification of the escutcheon for mounting the escutcheon on doors having different cross bore diameters. In particular, this combination provides a two-way modification of the door lock assembly to adapt to a door with a small cross bore, and to readapt the assembly to a door with a large cross bore without permanently altering the assembly.

According to another embodiment of the present invention, a door lock assembly is provided with an escutcheon assembly having a plate with a through-hole for mounting, and a latch mechanism partially inserted in the through-hole with a handle for operating the latch mechanism. The latch mechanism further includes a bushing having a drive head for coupling to the handle so as to rotate with the handle, an abutment portion spaced from a distal end of the drive head, and an ear protruding from a portion of the bushing intermediate to the distal end of the drive head and the abutment portion. The plate with the through-hole further includes an opening communicating with the through-hole for receiving the ear of the bushing when the bushing is inserted in the through-hole. Accordingly, when the ear is passed through the opening and the bushing is rotated, the ear slidably engages an outside of the through-hole to prevent axial removal of the bushing. This combination, therefore, provides a latch mechanism that can be easily assembled to the escutcheon without the need for an extra part such as a circular clip to axially secure the bushing of the latch mechanism to the escutcheon.

BRIEF DESCRIPTION OF THE DRAWINGS

The invention and further advantageous refinements of the invention according to the features of the claims are explained in more detail below with the aid of diagrammatic, exemplary embodiments in the drawings, in which:

DETAILED DESCRIPTION OF THE PREFERRED EMBODIMENTS

Figure 1:
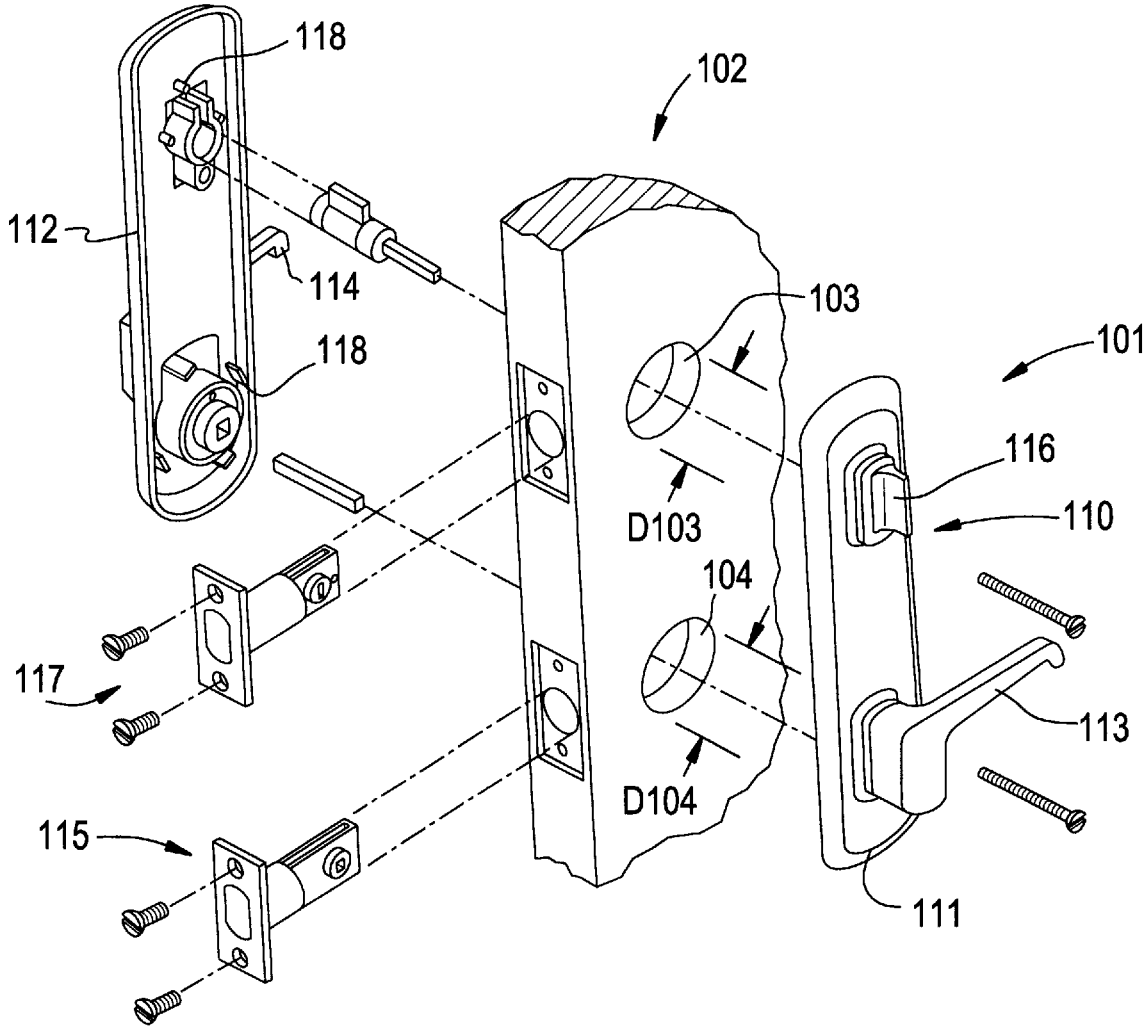
FIG. 1 PRIOR ART
FIG. 1 is an exploded perspective view of a conventional door lock assembly.
Figure 2:
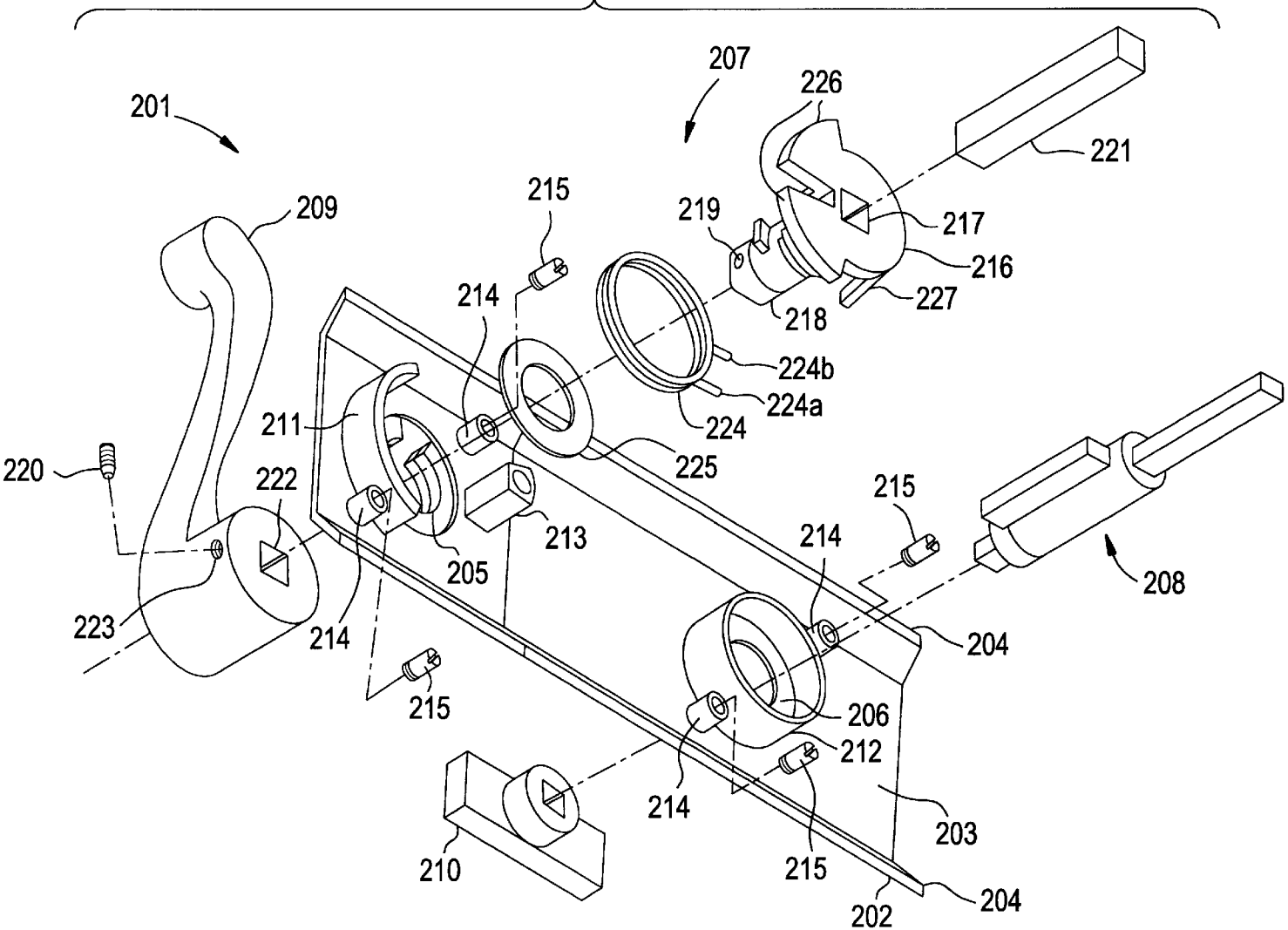
FIG. 2 is an exploded perspective view of a door lock assembly in accordance with the present invention.

With reference to FIG. 2, this invention is illustrated with respect to a door lock assembly 201 having an escutcheon 202 and both a latch mechanism and a deadbolt mechanism. Certain details of the door lock assembly are omitted for clarity. While this invention is shown for use with both latch and deadbolt mechanisms, it is to be understood that the invention may be used for either mechanism alone, or in other related designs that require an escutcheon to be mounted to a bore.

The door lock assembly 201 illustrated in FIG. 2 includes a latch mechanism 207 operated by a handle 209, and a deadbolt mechanism 208 operated by a thumb turn 210. The latch mechanism 207 and a deadbolt mechanism 208 are carried by the escutcheon 202.

The latch mechanism 207 includes a bushing 216 having a recess (preferably square) 217 on its inboard side for coupling with the shaft (preferably square) 221. The bushing 216 also has a drive head (preferably square) 218 formed on the inboard side of the bushing 216 and a threaded hole 219 extending radially in the drive head 218 for securing the handle 209 to the bushing with a set screw 220. The handle 209 includes a recess (again, preferably square) 222 for coupling with the square drive head 218 on the bushing 216. The handle 209 further includes a radially extending hole 223 for receiving the set screw 220, thereby securely coupling the handle to the bushing for rotational movement therewith without any relative slip.

In order to maintain proper angular centering of the handle 209, the door latch mechanism 207 uses a torsion spring 224 having ends 224*a*, 224*b* resting against a stop 213 formed on the escutcheon 202. The bushing 216 has an off-centered protrusion 227 formed thereon for engagement with either end of the torsion spring upon rotation of the bushing. Accordingly, centering of the handle and bushing is obtained through direct coupling of the bushing to the spring without the need for a special centering washer. The bushing 216 also includes a stop arms 226 that abut against stop 213 upon rotation of the bushing so as to limit the angular displacement of the bushing. The washer 225 illustrated in FIG. 2 is a conventional washer to facilitate rotation of the bushing.

The escutcheon 202 has a central plate portion 203 and side flange portions 204 protruding in the same direction away from the central plate portion towards the door (i.e., protruding from the inward-facing side of the escutcheon). Through-holes 205 and 206 are formed in the central plate portion for accessing the latch mechanism 207 and deadbolt mechanism 208 using the latch handle 209 and the thumb turn 210, respectively. Guide portions 211 and 212 and stop 213 are integrally formed with the central plate portion 203 so as to protrude from the inward-facing side of the escutcheon. Guide portion 211 and stop 213 are adapted to support and guide the movement of the latch mechanism 207, in addition to being adapted to fit snugly within a door cross bore having a certain minimum diameter defined by the distance between the apex of the guide portion 211 and that of the stop 213. Similarly, guide portion 212 supports the deadbolt mechanism, while also being adapted to fit snugly within a door cross bore having a certain minimum diameter defined by the distance between the two furthest apices of this guide portion.

Post mounts 214 are integrally formed with the central plate portion 203 so as to protrude from the inside of the escutcheon. The post mounts are in the form of cylindrical or square blocks or the like and have tapped (i.e., threaded) holes in their centers for receiving removable posts 215. The post mounts are preferably even in number for each through-hole 205, 206, so that each pair of post mounts can be diametrically opposed to each other and equidistant from the center of the corresponding through-hole. As will be discussed below, these post mounts and their removable posts are used to mount the escutcheon to the door latch and deadbolt cross bores. Although only one pair of post mounts 214 and removable posts 215 are shown for each through-hole 205, 206, it is understood that the invention may include any number, keeping in mind that the location and number of these components define the extent to which the escutcheon, and, thus, the lock assembly, can be readily adapted for mounting to different cross bore diameters.

Figure 3:
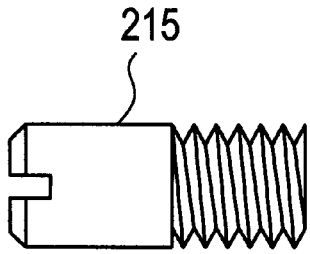
FIG. 3 is a side elevation view of a headless screw that can be used with the post mount on the escutcheon to form the removable post in accordance with the present invention.

Since the removable posts 215 are used to mount the escutcheon snugly to the cross bores, it is preferable that the removable posts take the form of a slotted headless screw as shown in FIG. 3. This facilitates the mounting of the escutcheon with the removable posts inserted in the post mounts, as well as their removal from (and reinsertion in) the post mounts.

While the post mounts have been described as having threaded holes and the removable posts as being in the form of a threaded screw, the invention also contemplates post mounts without threaded holes and removable posts without threads. For example, either or both the post mount holes and the removable posts can have a smooth or rough surface, such that when they are coupled, a satisfactory tight fit results. As such, the removable posts will be securely coupled to the post mounts while mounting the door lock assembly.

Also, while the guide portions, stop, and post mounts are described as preferably being molded with the escutcheon, other methods such as soldering or welding may be used for integrally forming these components with the escutcheon.

Figure 4:
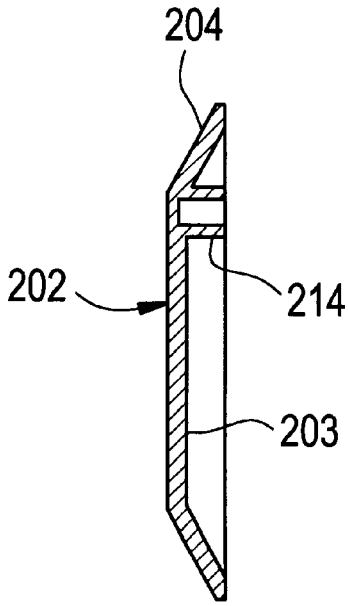
FIG. 4 is a cross-section taken along section 4A—4A of FIG. 5 showing the height of the post mount relative to the side flange portion of the escutcheon in accordance with the present invention.

Referring now to FIG. 4, in a preferred aspect of the invention, the post mounts 214 are flush with the distal ends of the side flange portions 204. This facilitates the manufacturing of the escutcheon, since machining and finishing of the inward facing side of the entire escutcheon can be performed in the same plane. Nevertheless, the post mounts 214 may be lower than the side flange portions 204. On the other hand, if the post mounts are higher than the side flange portions such they protrude beyond the side flange portions, then the inward facing side of the escutcheon will not lay flush against the door surface when mounted in a large cross bore with the removable posts removed.

While the forgoing detailed description is with reference to one escutcheon (i.e., the inner escutcheon for the door lock assembly), it is understood that the outer escutcheon can have similar features, as required, to ensure that it too fits snugly in the cross bore when mounted. Accordingly, a detailed description of the outer escutcheon is not needed.

Figure 5:
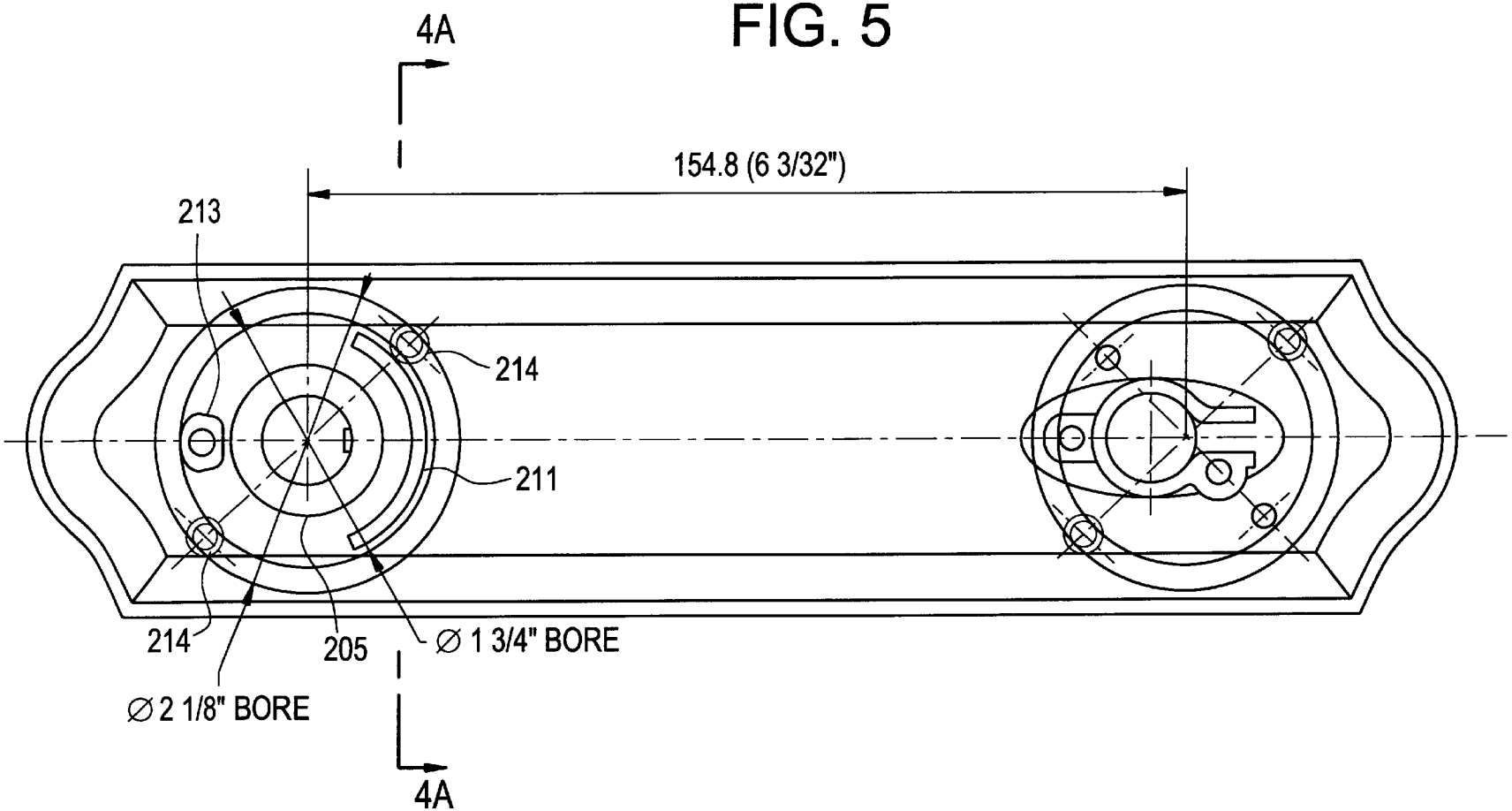
FIG. 5 is a front elevation view of the escutcheon showing the relative locations of the removable posts in accordance with the present invention with two cross bore diameters superimposed thereon.

FIG. 5 illustrates the door lock assembly with two cross bore sizes superimposed thereon. With the removable posts 215 properly inserted in the post mounts 214, the escutcheon 202 can be mounted to a door having a first cross bore diameter of a relatively larger size (shown here as 2⅛ in. diameter). However, when the removable posts 215 are unscrewed and removed from the post mounts 214, the escutcheon can be mounted to a door having a second cross bore diameter of a relatively smaller size (shown here as 1¾ in. diameter).

Figure 6:
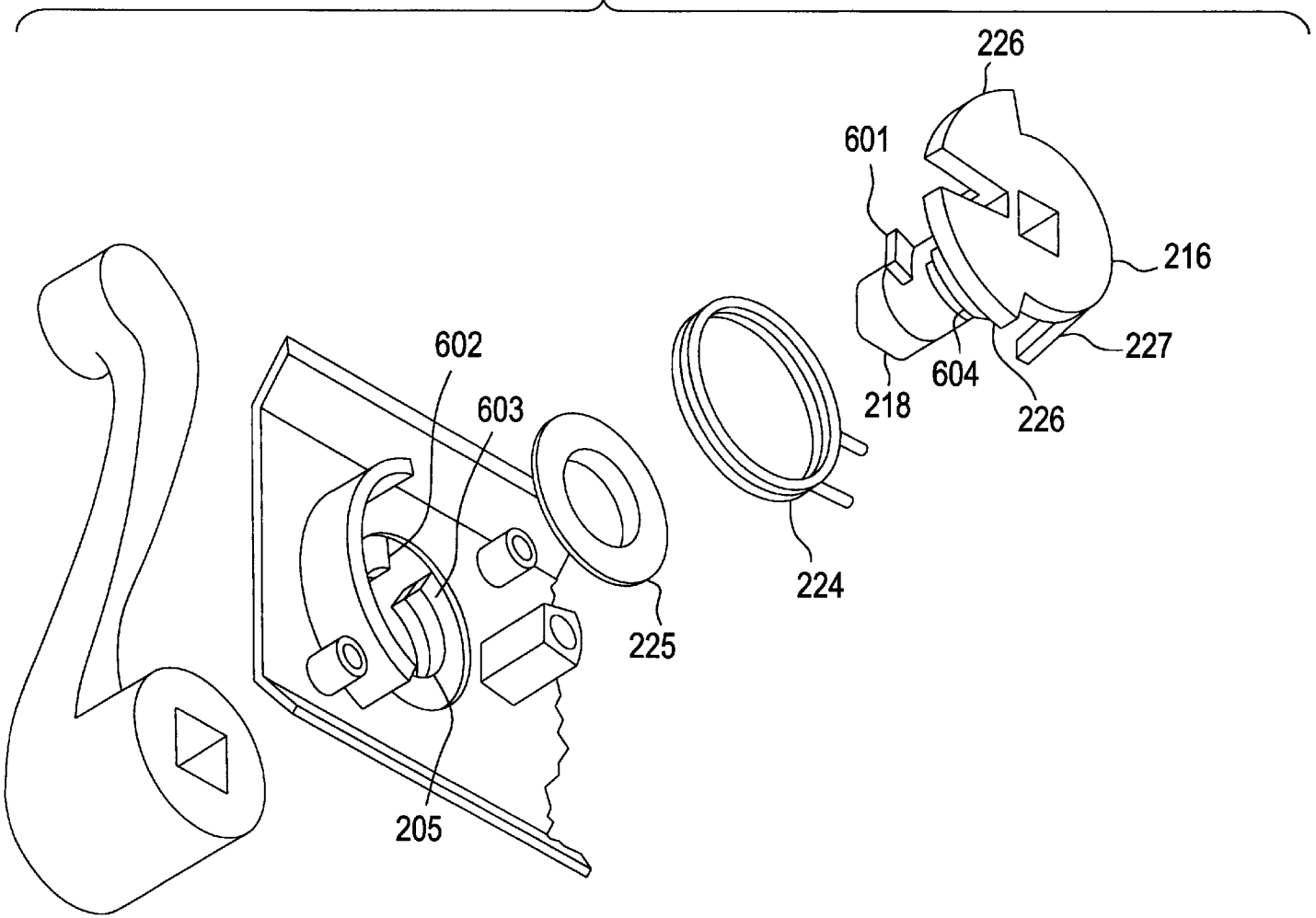
FIG. 6 is a second exploded perspective view of the door lock assembly showing the cooperation portions of the latch mechanism and the escutcheon in accordance with the present invention.

Referring to FIG. 6, the latch mechanism in accordance with another embodiment of the present invention will be described. FIG. 6 is similar to FIG. 2, but eliminates certain details of the door lock assembly for clarity.

As shown in FIG. 6, the latch bushing 216 includes an ear 601 radially protruding from a portion of the latch bushing intermediate to the distal end of the drive head 218 and an off centered protrusion 227. The escutcheon through-hole 205 includes a corresponding opening 602, which, for example, can be set at the 10:00 o'clock position as shown in the figure, for allowing the ear 601 to pass through when assembling the bushing to the escutcheon. In a preferred design, the opening is formed in an annular portion of the through-hole as shown in the figures so as to create an incomplete annular portion or penannular portion 603.

Figure 7:
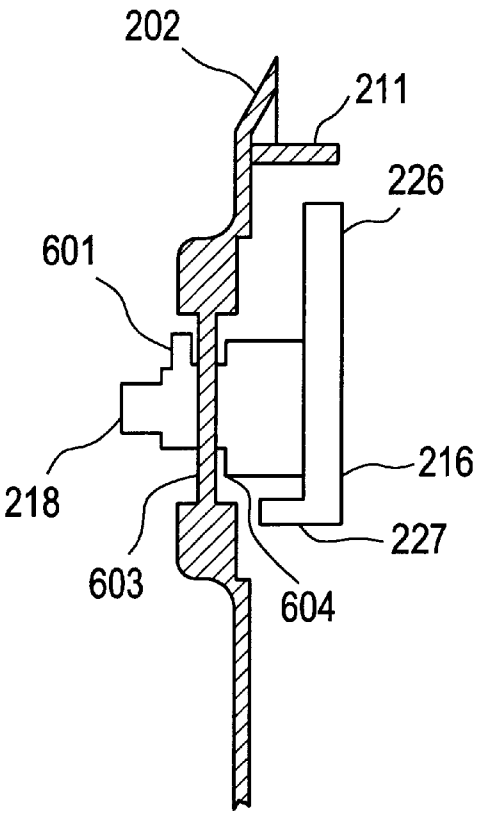
FIG. 7 is a partial sectional side view of the door lock assembly showing the cooperation between portions of the latch mechanism and the escutcheon in accordance with the present invention.

During assembly, the ear 601 is inserted in the opening past the penannular portion 603 with the torsion spring 224 interposed between the bushing and the escutcheon. The bushing is then rotated so that the penannular portion is positioned between the ear and an abutment portion of the bushing. In FIG. 6, the abutment portion is shown, for example, as an annular portion 604 having an outer diameter that is greater than an inner diameter of the penannular portion 603. FIG. 7 is a partial sectional side view showing the cooperation of the ear 601, the penannular portion 603, and the annular portion 604 (the washer 225 and the torsion spring have been left out for clarity). With this arrangement, the bushing is axially secured to the escutcheon prior to assembly of the handle while also being rotatable within a certain rotational range. Furthermore, there is no requirement for a circular clip to secure the bushing to the escutcheon during assembly of the latch mechanism to the escutcheon. Also, as discussed above, the torsion spring ensures proper centering of the handle and bushing through direct coupling of the bushing to the spring without the need for a special centering washer.

In use, therefore, the door lock assembly of the invention described above is advantageous, since it allows easy removal of the removable posts from the post mounts in order to adapt the escutcheon to one cross bore dimension, and re-adapt the escutcheon to it former state by easily reinserting the removable posts back into the post mounts. Both removal and reinsertion of the screws can be performed using the same tool (e.g., a screw driver), and without damaging or permanently altering the escutcheon. Therefore, the invention provides a door lock assembly that can be modified and re-modified on-site for mounting to doors having different cross bore diameters, since removal of the removable posts is performed without permanently altering the structure of the escutcheon.

Furthermore, when the bushing for the latch mechanism is provided with an ear and the through-hole is provided with a penannular portion that cooperates with the ear, assembling the latch mechanism can be achieved easily without the need for an extra part such as a circular clip to axially secure the bushing to the escutcheon.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed:

1. A door lock assembly, comprising:

a first escutcheon assembly for mounting a door lock mechanism, the first escutcheon assembly comprising:

a first plate having a first through-hole;

side flange portions having distal ends that lay in a mounting plane of the first escutcheon, such that when the first escutcheon is mounted on an outside vertical door surface, the distal ends contact the door surface;

a first post mount formed on an inward facing side of the first plate outside the first through-hole;

a first removable post that is removable coupled to the first post mount such that the first removable post is removable without permanent alteration to the first escutcheon assembly;

a second post mount diametrically opposed to the first post mount and equidistant from the center of the first through-hole, a second removable post that is removably coupled to the second post mount such that the second removable post is removable without permanent alteration to the first escutcheon assembly, and a stop protruding from the inward facing side of the first plate; and wherein the first post mount extends from the inward facing side of the first plate to a position that is substantially equal to or below the distal ends; and wherein the door lock assembly further comprising a latch mechanism inserted in the first through-hole, and a handle for operating the latch mechanism; and wherein the latch mechanism comprises:

a bushing having a recess on an inboard side of the bushing, a drive head on an outboard side of the bushing coupled to the handle so as to rotate with the handle without relative slip, and an off-centered protrusion protruding radially outward from the bushing;

a shaft coupled with the bushing recess so as to rotate with the bushing without relative slip; and a torsion spring for centering an angular position of the handle about the first through-hole in the first escutcheon, the torsion spring including two distal ends resting against the stop, wherein at least one distal end is engaged with the off-centered protrusion of the busing, so that centering of the handle and bushing is obtained through direct coupling of the bushing to the torsion spring.

2. A door lock assembly, comprising:

a first escutcheon assembly for mounting a door lock mechanism, the first escutcheon assembly comprising:

a first plate having a first through-hole;

side flange portions having distal ends that lay in a mounting plane of the first escutcheon, such that when the first escutcheon is mounted on an outside vertical door surface, the distal ends contact the door surface;

a first post mount formed on an inward facing side of the first plate outside the first through-hole;

a first removable post that is removable coupled to the first post mount such that the first removable post is removable without permanent alteration to the first escutcheon assembly;

a second post mount diametrically opposed to the first post mount and equidistant from the center of the first through-hole, and a second removable post that is removably coupled to the second post mount such that the second removable post is removable without permanent alteration to the first escutcheon assembly;

a second through-hole in the first plate;

a third post mount formed on an inward facing side of the first plate outside the second through-hole;

a third removable post that is removably coupled to the third post mount such that the third removable post is removable without permanent alteration to the first escutcheon assembly;

a fourth post mounted diametrically opposed to the third post mount and equidistant from the center of the second through-hole; and a fourth removable post that is removably coupled to the fourth post mount such that the fourth removable post is removable without permanent alteration to the first escutcheon assembly; and wherein the first post mount extends from the inward facing side of the first plate to a position that is substantially equal to or below the distal ends.

3. The door lock assembly according to claim 2, further comprising a latch mechanism inserted in the first through-hole, and a handle for operating the latch mechanism; and a deadbolt mechanism inserted in the second through-hole, and a thumb turn for operating the deadbolt mechanism.

4. The door lock assembly according to claim 3, wherein the first through fourth post mounts each has a female threaded hole, and the first through fourth removable posts each has a male thread for removably coupling the first through fourth removable posts to the first through fourth post mounts, respectively.

5. A door lock assembly, comprising:

a first escutcheon assembly for mounting a door lock mechanism, the first escutcheon assembly comprising:

a first plate having a first through-hole;

side flange portions having distal ends that lay in a mounting plane of the first escutcheon, such that when the first escutcheon is mounted on an outside vertical door surface, the distal ends contact the door surface;

a first post mount formed on an inward facing side of the first plate outside the first through-hole;

a first removable post that is removably coupled to the first post mount such that the first removable post is removable without permanent alteration to the first escutcheon assembly;

a second post mount diametrically opposed to the first post mount and equidistant from the center of the first through-hole, and a second removable post that is removably coupled to the second post mount such that the second removable post is removable without permanent alteration to the first escutcheon assembly;

a second through-hole in the plate;

a third post mount formed on an inward facing side of the first plate outside the second through-hole;

a third removable post that is removably coupled to the third post mount such that the third removable post is removable without permanent alteration to the first escutcheon assembly;

a fourth post mount diametrically opposed to the third post mount and equidistant from the center of the second through-hole; and a fourth removable post that is removably coupled to the fourth post mount such that the fourth removable post is removable without permanent alteration to the first escutcheon assembly; and wherein the door lock assembly further comprises a second escutcheon assembly comprising:

a second plate having a third and a fourth through-hole corresponding in position to the first and second through-hole on the first plate;

fifth and sixth post mounts formed on an inward facing side of the second plate outside the third through-hole;

fifth and sixth removable posts that are removably coupled to the fifth and sixth post mounts, respectively, such that the fifth and sixth removable posts are removable without permanent alteration to the second escutcheon assembly;

seventh and eighth post mount formed on an inward facing side of the second plate outside the fourth through-hole; and seventh and eighth removable posts that are removably coupled to the seventh and eighth post mounts, respectively, such that the seventh and eighth removable posts are removable without permanent alteration to the second escutcheon assembly; and wherein the first post mount extends from the inward facing side of the first plate to a position that is substantially equal to or below the distal ends.

6. The door lock assembly according to claim 5, further comprising a latch mechanism inserted in the first and third through holes, and a handle for operating the latch mechanism; and a deadbolt mechanism inserted in the second and fourth through-hole, and a thumb turn for operating the deadbolt mechanism.

7. A door lock assembly, comprising:

a first escutcheon assembly for mounting a door lock mechanism, the first escutcheon assembly comprising:

a first plate having a first through-hole;

side flange portions having distal ends that lay in a mounting plane of the first escutcheon, such that when the first escutcheon is mounted on an outside vertical door surface, the distal ends contact the door surface;

a first post mount formed on an inward facing side of the first plate outside the first through-hole;

a first removable post that is removably coupled to the first post mount such that the first removable post is removable without permanent alteration to the first escutcheon assembly;

a second post mount diametrically opposed to the first post mount and equidistant from the center of the first through-hole, and a second removable post that is removably coupled to the second post mount such that the second removable post is removable without permanent alteration to the first escutcheon assembly; and wherein the first post mount extends from the inward facing side of the first plate to a position that is substantially equal to or below the distal ends; and wherein the door lock assembly further comprising a latch mechanism inserted in the first through-hole, and a handle for operating the latch mechanism; and wherein the latch mechanism comprises a bushing having a drive head on an outboard side of the bushing coupled to the handle so as to rotate with the handle, an abutment port on spaced from a distal end of the drive head, and an ear protruding from a portion of the bushing intermediate to the distal end of the drive head and the abutment portion; and wherein the first plate having the first through-hole further comprises an opening communicating with the first through-hole for receiving the ear of the bushing when the bushing is inserted in the first through-hole, such that when the ear is passed through the opening and the bushing is rotated, the ear slidably engages an outside of the first through-hole to prevent axial removal of the bushing.

8. The door lock assembly according to claim 7, wherein the first through-hole in the first plate is defined by a penannular portion that includes the opening for the ear, and wherein the ear is passed through the penannular portion and the bushing is rotated, the ear slidably engages the penannular portion to prevent axial removal of the bushing.

9. The door lock assembly according to claim 8, wherein the abutment portion of the bushing is an annular portion positioned so as to abut against the penannular portion when the ear is passed through the penannular portion and the bushing is rotated.

10. A door lock assembly, comprising:

a first escutcheon assembly for mounting a door lock mechanism, the first escutcheon assembly comprising:

a first plate having a first through-hole;

a first post mount formed on an inward facing side of the first plate outside the first through-hole;

a first removable post that is removably coupled to the first post mount such that the first removable post is removable without permanent alteration to the first escutcheon assembly;

a second post mount diametrically opposed to the first post mount and equidistant from the center of the first through-hole;

a second removable post that is removably coupled to the second post mount such that the second removable post is removable without permanent alteration to the first escutcheon assembly; and a deadbolt mechanism inserted in the first through-hole, and a thumb turn for operating the deadbolt mechanism; and wherein the first and second post mounts each has a female threaded hole, and the first and second removable posts each has a male thread for removably coupling the first removable post to the first post mount.

11. The door lock assembly according to claim 10, wherein the first escutcheon further comprises a side flange portions having distal ends that lay in a mounting plane of the first escutcheon, such that when the first escutcheon is mounted on an outside vertical door surface, the distal ends contact the door surface; and wherein the first and second post mounts extend from the inward facing side of the first plate to a position that is substantially equal to or below the distal ends.

* * * * *